US005167039A

United States Patent [19]

Sim

[11] Patent Number: 5,167,039

[45] Date of Patent: Dec. 1, 1992

[54] TOILET ASSEMBLY

[76] Inventor: Jae K. Sim, 5021 Crescent Dr., Anaheim, Calif. 92807

[21] Appl. No.: 835,531

[22] Filed: Feb. 14, 1992

[51] Int. Cl.[5] ..... E03D 9/04

[52] U.S. Cl. ..... 4/216

[58] Field of Search ..... 4/213, 216, 217, 348-352

[56] References Cited

U.S. PATENT DOCUMENTS

| | | | |
|---|---|---|---|
| 2,227,920 | 1/1941 | Baither | 4/213 |
| 2,297,935 | 10/1942 | Baither | 4/213 |
| 2,329,221 | 9/1943 | Sanford | 4/213 |
| 2,443,705 | 6/1948 | Fitzgerald | 4/215 |
| 2,575,778 | 11/1951 | Wilson | 4/213 |
| 2,817,099 | 12/1957 | Fitzgerald | 4/215 |
| 2,847,682 | 8/1958 | Shay | 4/213 |
| 3,495,282 | 2/1970 | Taggart | 4/213 |
| 3,805,304 | 4/1974 | Ikehata | 4/213 X |
| 4,222,129 | 9/1980 | Baker | 4/213 |
| 4,232,406 | 11/1980 | Beeghly et al. | 4/213 |
| 4,318,192 | 3/1982 | Williams et al. | 4/213 |
| 4,365,361 | 12/1982 | Sanstrom | 4/213 |
| 4,494,255 | 1/1985 | Drummond | 4/213 |
| 5,005,222 | 4/1991 | Sim | 4/216 |
| 5,054,131 | 10/1991 | Sim | 4/216 |
| 5,079,782 | 1/1992 | Sim | 4/216 |
| 5,083,322 | 1/1992 | Goodman | 4/213 |

*Primary Examiner*—Charles E. Phillips

*Attorney, Agent, or Firm*—Birch, Stewart, Kolasch & Birch

[57] ABSTRACT

A non-siphon type ventilating toilet assembly includes an U-shaped ventilation tube disposed in the toilet holding tank for ventilating objectionable odor from the toilet bowl, the ventilation tube containing a cap valve which moves upwardly and downwardly along an outer-screwing shaft of an upper motor and a fan of a side motor, and both motors connected to a motion sensor, whereby upon opening the toilet seat cover having a sensor aperture, while the user sits on the seat ring, the motion sensor actuates for allowing both motors to be operated and simultaneously the cap valve is in an open position and the objectionable odor is ventilated, and in turn when the user stands up and flushes the toilet assembly, the motion sensor deactivates for allowing both motors to be stopped and simultaneously the cap valve is in a closed position and the flush water discharges the waste products to the sewer discharge line.

9 Claims, 2 Drawing Sheets 2
28
27
26
62
13
25
24
10
22
30
12
23
18
55
17
29
11
16
16
14
2

40
13
21
44
36
30
48
33
12
15
17
16
14
19
21
20

TOILET ASSEMBLY

BACKGROUND OF THE INVENTION

1. Field of the Invention

The present invention relates to a non-siphon type toilet assembly and more particularly, to a two piece toilet assembly which includes an U-shaped ventilation tube disposed in the toilet water holding tank, the ventilation tube containing a circular plate valve which can be opened or closed by actuation of a motion sensor, whereby while the user sits on the seat ring, the objectionable odor is ventilated.

2. Description of the Prior Art

Various types of non-siphon type ventilating toilets are generally known in the art to be utilized with a fan for ventilating contaminated air through a separate exhaust duct. Several types of non-siphon type ventilating toilets are known in the art as an European type toilet to be utilized with a gas exhaust conduit disposed adjacent to a toilet stool and connected to a sewer discharge line and a fan/motor connected to an on/off switch of a light of the toilet.

However, these toilets suffer from a number of problems such as, for example, (1) the waste product and associated objectionable odor does not clearly discharge directly to the sewer discharge line since the ventilating conduit is directly connected to the sewer discharge line, (2) these conventional toilets are very complicated in structure, expensive to manufacture, and difficult to use, (3) since the flush water can flow into the ventilating conduit, the amount of water and the water pressure of the flush water are minimized so that these toilets cannot effectively achieve the flushing purpose thereof, and (4) since such toilets are utilized with relay type or an on/off switches for activation of the fan, this switch may be out of order frequently. Furthermore, such toilets may not employ the use of a water overflowing system and even if the system used, it may be very complicated in structure and inefficient in use.

Such toilets are described in Baither U.S. Pat. No. 2,227,920, Baither U.S. Pat. No. 2,297,935, Sanford U.S. Pat. No. 2,329,221, Fitzgerald U.S. Pat. No. 2,443,705, Wilson U.A. Pat. No. 2,575,778, Fitzgerald U.S. Pat. No. 2,817,099, Shay U.S. Pat. No. 2,847,682, Taggart U.S. Pat. No. 3,495,282, Ikehata U.S. Pat. No. 3,805,304, Baker U.S. Pat. No. 4,222,129, Beeghly et al U.S. Pat. No. 4,232,406, Williams et al U.S. Pat. No. 4,318,192, Sanstrom U.S. Pat. No. 4,365,361, Drummond U.S. Pat. No. 4,494,255, and Higgins U.S. Pat. No. 4,865,664.

In order to avoid these problems, U.S. Pat. No. 5,005,222, issued to the present inventor, discloses a toilet assembly which includes a toilet stool having a ventilation conduit disposed adjacent to the back wall portion of the toilet stool wherein the ventilation conduit extends angularly around a siphon conduit at the point where they communicate with a sewer discharge line, a fan member disposed in the lower portion of the ventilation conduit, a toilet water holding tank having a motion sensor disposed on the front exterior thereof and free of interference from the opening and closing of a toilet seat cover, a multifunctional tube having an U-shaped configuration and disposed in the toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion sensor actuates the fan member allowing the objectionable odor to be ventilated, and in turn when the user stands up and flushes the toilet assembly, the motion sensor deactivates and simultaneously the flush water discharges the waste products and associated objectional odor directly to the sewer discharge line.

Another U.S. Pat. No. 5,079,782 issued to the present inventor, discloses a toilet assembly which includes a toilet stool having ventilation conduit disposed adjacent to the back wall portion of the toilet stool and a gas exhaust duct connected to the ventilation conduit and having a raised portion disposed at the interior surface thereof for allowing exhaust gas to flow from a flush ring to the ventilation conduit, said raised portion being provided with a water exiting tube for preventing the flush water from the water exiting tube from flowing into the ventilation conduit, whereby the flush water discharges the waste products and associated objectionable odor directly to the sewer discharge line.

Still another U.S. Pat. No. 5,054,131 issued to the present inventor, discloses a toilet assembly which includes a toilet stool having a ventilation conduit disposed adjacent to the back wall portion of the toilet stool and a U-shaped exhaust duct disposed in the toilet holding tank and connected to the ventilation conduit for allowing exhaust gas to flow from a flush ring to the ventilation conduit, whereby the flush water discharges the waste product and associated objectionable odor directly to the sewer discharge line. However, these toilet assemblies do not achieve to perfectly discharge the objectionable odor and are somewhat complicated in construction.

SUMMARY OF THE INVENTION

Accordingly, it is an object of the present invention to provide an improved ventilating toilet assembly having a two-piece unit whereby objectionable odor from the toilet bowl of the present invention is effectively ventilated therefrom and discharged into a sewer discharge line, which eliminates the above problems encountered in a conventional toilet assembly.

Another object of the present invention is to provide a non-siphon type ventilating toilet assembly which includes an U-shaped ventilation tube disposed in the toilet water holding tank for ventilating objectionable odor from the toilet bowl, the ventilation tube containing a circular valve plate which moves upwardly and downwardly along a shaft of an upper motor, and a fan of a side motor, both motors connected to a motion sensor, whereby upon opening the toilet seat cover, while the user sits on the seat ring, the motion sensor actuates for allowing the upper and side motors to be operated and simultaneously the circular plate valve is in an open position and the objectionable odor is ventilated, and in turn when the user stands up and flushes the toilet assembly, the motion sensor deactivates for allowing both motors to be stopped and simultaneously the circular plate valve is in a closed position and the flush water discharges the waste products to the sewer discharge line.

A further object of the present invention is to provide a ventilation toilet assembly which further comprises a water overflow controlling ball valve disposed to move in a net chamber disposed at the top area of an L-shaped upward tube for, upon overflowing of the flush water, allowing to discharge overflowing water thereinto.

Yet another object of the present invention is to provide a toilet assembly which further includes a motion sensor disposed within a waterproof box attached to the front middle exterior of the toilet water holding tank for activating an upper motor operatively associated with a circular valve plate with a plurality of vanes and a side motor with a fan.

Still yet another object of the present invention is to provide a toilet assembly which is simple in structure, inexpensive to manufacture, durable in use, and refined in appearance.

Other objects and further scope of applicability of the present invention will become apparent form the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a non-siphon type toilet assembly which includes an U-shaped ventilation tube disposed in the toilet water holding tank for ventilating objectionable odor from the toilet bowl, the ventilation tube containing a circular plate valve which moves upwardly and downwardly along an outer-screwing shaft of an upper motor and a fan of a side motor, and both motors connected to a motion sensor disposed on the front exterior of the toilet water holding tank, whereby upon opening a toilet seat cover having a sensor aperture, while the user sits on the seat ring, the motion sensor actuates for allowing both motors to be operated simultaneously the circular plate valve is in an open position and the objectionable odor is ventilated, and in turn when the user stands up and flushes the toilet assembly, the motion sensor deactivates for allowing both motors to be stopped and simultaneously the circular plate valve is in a closed position and the flush water discharges the waste products to the sewer discharge line.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
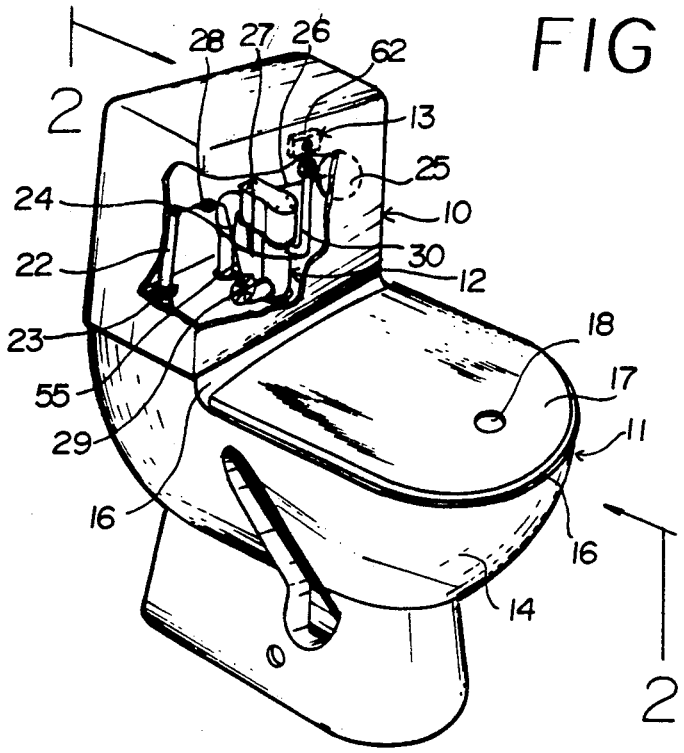
FIG. 1 is a perspective view of the toilet assembly according to the present invention containing cut-away portions in order to illustrate the construction of the toilet assembly of the present invention.
Figure 2:
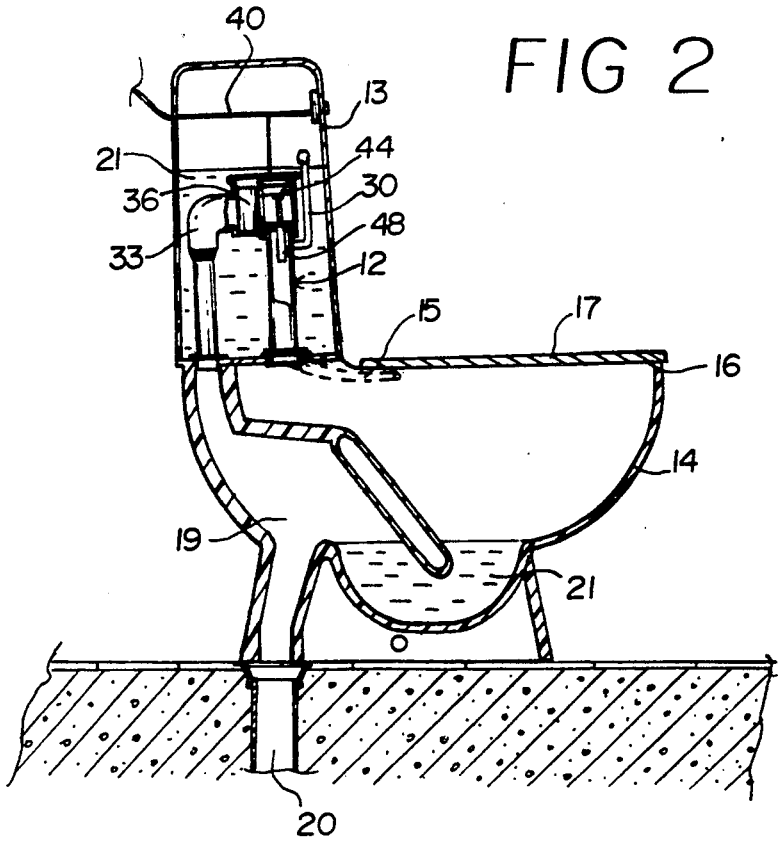
FIG. 2 is a sectional view of FIG. 1, taken along lines 2—2.

Referring now in detail to the drawings for the purpose of illustrating preferred embodiments of the present invention, the toilet assembly as shown in FIGS. 1 and 2, comprises a toilet water holding tank 10, a toilet stool 11, an U-shaped ventilation tube or a multifunctional tube 12 disposed in the toilet water holding tank 10, and a motion sensor member 13 disposed on the front exterior of the toilet water holding tank 10.

The toilet stool 11 includes a toilet bowl 14 having an arc-shaped water flush guiding pipe 15 disposed at the upper portion of the toilet bowl 14 for allowing fresh flush water to be flushed into the toilet bowl 14 and a seat ring 16 operatively located on the top of the toilet bowl 14. The toilet stool 11 further includes a toilet seat cover 17 having a sensor aperture 18 operatively located on the seat ring 16 and pivotally connected to the seat ring 16 by pivotal hinges (not shown) and a non-siphon passage 19 disposed in the toilet bowl 14 and communicated with the U-shaped tube 12 for discharging waste products and associated objectionable odor directly from the toilet bowl 19 to a sewer discharge line 20.

The toilet water holding tank 10 contains the fresh flush water 21 to be flushed into the toilet bowl 14 through the water flush guiding pipe 15 of the toilet stool 11. The toilet water holding tank 10 includes a water supply tube 22 connected to a water supply line (not shown) through a water intake valve 23 disposed at the bottom end thereof and a float valve 24 disposed at the top end thereof, a float member 25 connected to the float valve 24 through a rod 26. The toilet water holding tank 10 further includes a water hose 27 connected to an L-shaped upward tube 30 for allowing the flush water to be filled out the toilet water holding tank 10 and a flush handle 28 disposed on the side exterior of the toilet holding tank 10 for connection to a flapper valve 29 through a chain 55. The water supply tube 22 stands at the toilet holding tank 10.

Figure 3:
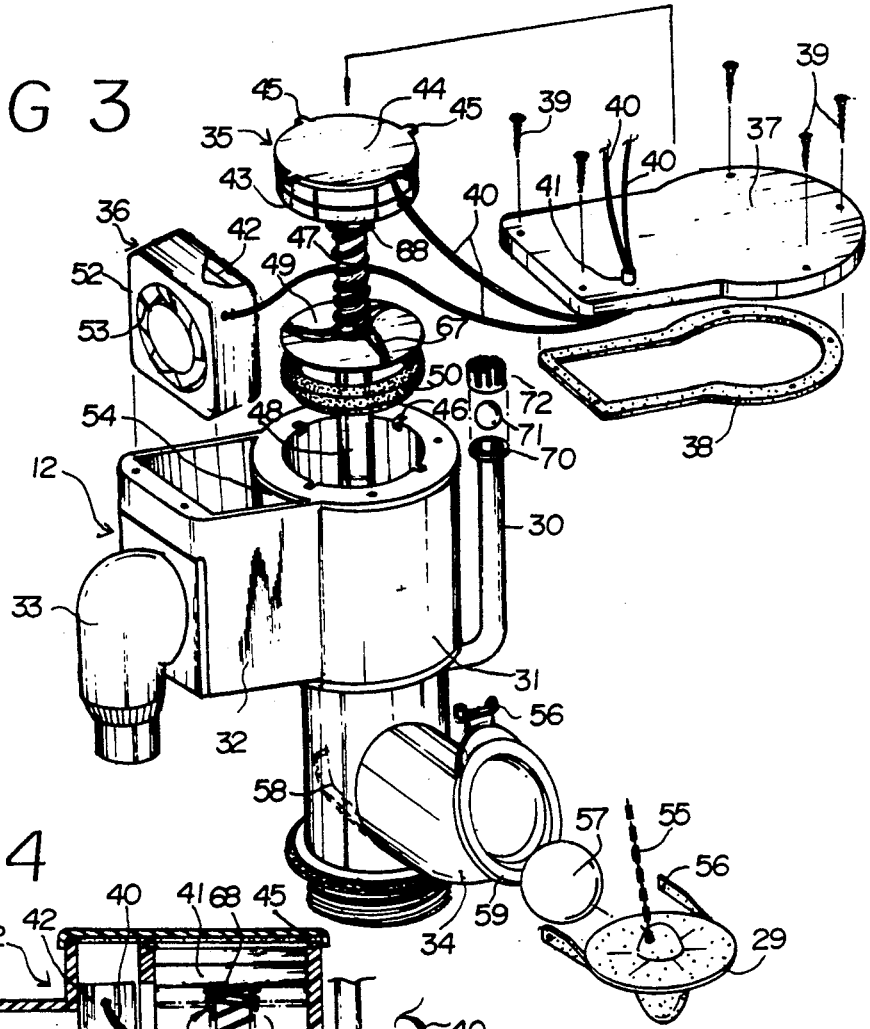
FIG. 3 is an exploded perspective view of an U-shaped ventilation tube disposed in the toilet holding tank according to the present invention.
Figure 4:
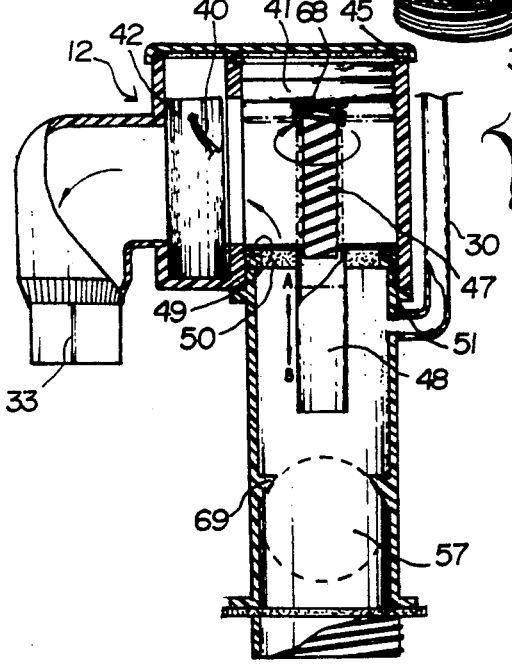
FIG. 4 is a perspective view of the U-shaped tube containing cut-away portions in order to illustrate the construction thereof according to the present invention.

As shown in FIGS. 3 and 4, the multifunctional tube 12 has an U-shaped configuration and disposed in the toilet water holding tank 10. The multifunctional tube 12 includes a vertical main tube 31 supported on the bottom of the toilet water holding tank 10, a pocket 32 extended from one side upper wall of the vertical main tube 31, an L-shaped downward tube 33 extended from the pocket 32, and a horizontal flapper tube 34 extended from the lower wall of the vertical main tube 31. And the L-shaped upward tube 30 is connected to the middle exterior surface of the main vertical tube 31.

A valve member 35 and a fan member 36 are inserted into the upper portion of the main tube 31 and the pocket 32, respectively. A cover 37 for closing the top of the U-shaped multifunctional tube 12 with a cover packing 38 by a plurality of bolts 39 contains a wire aperture 41 for keeping electrical wires 40 connected to a valve motor 43 and a fan motor 42 and the motion sensor member 13.

The valve member 35 includes a valve motor container 44 containing the valve motor 43, a plurality of extensions 45 extended from the valve motor container 44 for hanging on the circumferential top of the vertical main tube 31 at a plurality of grooves 46 disposed on the circumferential top of the main tube 31, and an outer-screwing co-axial shaft 47 of the valve motor 43 being in a screwing relationship with an inner-screwing shaft 48 extended from a circular plate valve 49.

The circular plate valve 49 having a plurality of vanes 67 extended from the top thereof and provided with a rubber gasket 50 is tightly closed on a raised portion 51 disposed at the interior surface of the vertical main tube 31. The plurality of vanes 67 of the circular plate valve 49 form a raised portion so that since resistance is generated therefrom while the circular plate valve 49 rotates with the valve motor 43, the circular plate valve 49 is slidably attached the bottom of the valve motor 43 during the operation thereof and in turn during the inoperation thereof, the circular plate valve 49 is immediately separated from the valve motor 43 because of the plurality of vanes 67 thereof and a spring 68.

Also, the circular plate valve 49 is provided with the spring 68 for engaging with the outer-screwing co-axial shaft 47 and the top of the plate valve 49 so as to prevent the plate valve 49 from slidably attaching to and allowing easy separation from the bottom of the valve motor 43.

When the valve motor 42 actuates, the outer-screwing co-axial shaft 47 simultaneously rotates in the clockwise direction. Therefore, the circular plate valve 49 moves upwardly to the bottom of the valve motor 43 through the inner-screwing shaft 48 thereof after releasing the circular valve plate 49 from the raised portion 51 of the vertical main tube 31 (FIG. 2). At this time, the circular plate valve 49 is in an opened position dotted lines of (FIG. 4).

However, when the valve motor 43 is deactivated by the motion sensor 13 (FIG. 1), the circular plate valve 49 with the inner-screwing shaft 48 moves downwardly very fast due to the plurality of vanes 67 and the spring 68 thereof and tightly close against the raised portion 51. Thus the vertical main tube 31 is in a closed position (FIG. 4) so that the closed circular plate valve 49 can always prevent the objectionable gas from the sewer discharge line 20 from flowing backward.

The fan member 36 includes a housing 52 containing the fan motor 42 and a fan 53 for readily exhausting the objectionable odor from the main tube 31 into the L-shaped downward tube 33 through one side opening 54 disposed in the side wall of the main tube 31 (FIG. 4). Since the L-shaped downward tube 33 is communicated with the non-siphon passage 19, the objectionable odor from the L-shaped downward tube 33 is exhausted into the non-siphon passage 19 (FIG. 2).

As shown in FIG. 3, the flapper valve 29 is pivotally connected to the flapper tube 34 by hinges 56. A C-shaped guide line 58 is disposed in the center portion of the lower part of the vertical main tube 31 for guiding a movable ball valve 57 along the C-shaped guide line 58. The movable ball valve 57 is stopped by a stopper 69 disposed at the interior surface of the lower portion of the main tube 31. Also, the flapper valve 29 has an inclined inlet 59 for easily closing and opening by the flapper valve 29.

The motion sensor member 13 is disposed on the front exterior of the toilet water holding tank 11 in the middle portion of the front exterior thereof for matching with the sensor aperture 18 of the toilet seat cover 17 (FIG. 1).

Figure 5:
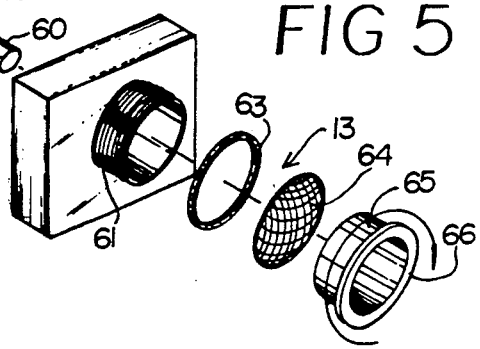
FIG. 5 is an exploded perspective view of a motion sensor member according to the present invention.

As shown in FIG. 5, the motion sensor member 13 includes a sensor box containing a motion sensor 60 connected to the electrical wire 40, a threaded tubular support 61 for inserting into a front aperture 62 of the toilet water holding tank 10 (FIG. 1), a rubber packing 63, a glass cover 64, and a tubular screw 65 having a circumferential extension 66 for attaching the sensor box to the front exterior of the toilet water holding tank 10 by screwing the tubular screw 65 on the tubular support 61.

Also, the motion sensor 60 is not an on/off type switch or relay type switch so that the motion sensor member 13 is durable when compared with the switch of the conventional vent toilet assemblies.

Furthermore, since the toilet seat cover 17 disposed on the peripheral top of the seat ring 16 has the sensor aperture 18, the motion sensor 60 is free of interference from the opening and closing of the toilet seat cover 17 (FIG. 1). The motion sensor 60 is connected to the electrical source (not shown) through the electrical wires 40, with DC 12 volts.

Also., the motion sensor 60 actuates for allowing the valve motor 43 and the fan motor 42 to be operated while the user sits on the seat ring 16 upon opening the toilet seat cover 17 and in turn the motion sensor 60 deactivates when the user stands up. On the other hand, the user is apart from the predetermined area from the motion sensor 60, the motion sensor 60 deactivates. The predetermined area is about 1 foot from the motion sensor 60.

As shown in FIG. 3, the L-shaped upward tube 30 is provided with a ball seat 70 disposed at the top thereof and a net ball cap 72 extended from the ball seat 70 for moving a water overflow controlling movable ball valve 71 between the ball seat 70 and the net ball cap 72 so as to allow to discharge overflowing flush water 21 from the toilet water holding tank 11 thereto by the float of the water overflow controlling movable ball valve 71 as described in U.S. Pat. No. 5,005,222 issued by the present inventor. The water hose 27 is connected to the upper portion of the L-shaped upward tube 30 for allowing the fresh flush water 21 to be passed into the L-shaped upward tube 30.

According to the present invention, the toilet assembly operates as follows.

First of all, upon opening the toilet seat cover 17, while the user sits on the seat ring 16, the motion sensor 60 actuates for allowing the valve motor 43 to be operated and simultaneously the fan motor 42 operates. At this time, since the circular plate valve 49 moves upwardly to the bottom of the valve motor 43 in the direction indicated by arrow A from arrow B as shown in dotted lines of FIG. 4, the objectionable odor from the toilet bowl 14 through the vertical main tube 31 is ventilated into the pocket 32 through the side opening 54 and passed along the L-shaped downward tube 33 and discharged to the non-siphon passage 19 and then the objectionable odor is directly discharged to the sewer line 20 (FIG. 2). Also, at that time, since the flapper valve 29 continuously maintains a closed state, the flush water 21 does not interfere so that the objectionable odor is effectively ventilated.

In turn, when the user stands and flushes the toilet assembly by pushing the flush handle 28, the motion sensor 60 deactivates and simultaneously the flapper valve 29 is open and the fresh flush water 21 flows to the toilet bowl 19 from the toilet water holding tank 10 through the water flush guiding pipe 15. At this time, since simultaneously the motion sensor 60 deactivates, the circular plate valve 49 moves downwardly to the interior raised portion 51 of the main tube 31 in the direction indicated by arrow from B to A.

Also, the movable ball valve 57 moves up along the C-shaped guide line 58 due to the water pressure to close the lower portion of the vertical main tube 31 through the stopper 69. Therefore, the flush water 21 effectively discharges the waste products and associated objectionable odor directly to the sewer discharge line 20 through the non-siphon passage 19.

If, while the user sits on the seat ring 16, when the user flushes the toilet assembly by pushing the flush handle 28, the ball valve 57 prevents the flush water from introducing into the upper portion of the main tube 31. Also, since the toilet assembly of the present invention is a non-siphon type, the waste products and associated objectionable odor can readily discharge to the sewer discharge line 20 through the non-siphon passage 19.

Thus, the toilet assembly of the present invention is simple in construction, compact for portability, inexpensive to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A non-siphon type ventilating toilet assembly comprising:

a toilet stool including a toilet bowl, a water flush guiding pipe communicating with said bowl for allowing flush water to be flushed into the toilet bowl a seat ring disposed on said bowl, a toilet seat cover disposed on the peripheral top of said seat ring, a sensor aperture disposed on said toilet seat cover and a non-siphon passage disposed in said toilet bowl for discharging waste products and associated objectionable odor directly from the toilet bowl to a sewer discharge line, a toilet water holding tank for containing flush water, said toilet holding tank having a water intake valve, a flapper valve disposed on a flapper tube, and a flush handle disposed on said tank for connection to said flapper valve, a U-shaped multifunctional tube disposed in said toilet water holding tank, said U-shaped multifunctional tube communicating with said toilet bowl and said flapper valve at the one end and connected to said non-siphon passage at the other end thereof, said multifunctional tube including:

a vertical main tube having a circumferential raised portion disposed on the interior surface thereof, a side opening disposed in a wall of the upper portion thereof, and a plurality of grooves disposed on the peripheral top thereof, a valve member slidably disposed in the upper portion of said vertical main tube, said valve member having a valve motor, a plurality of valve motor hangers for slidably engaging with said plurality of grooves of said vertical main tube, an outer-screwing motor shaft, a rubber gasket, a circular plate valve having a plurality of vanes, for sitting on said circumferential raised portion of the vertical main tube with the rubber gasket, and an inner-screwing tubular shaft extended from the center of said circular plate valve for being in a screwing relationship with said outer-screwing motor shaft, a pocket extended from said wall of the upper portion of said vertical main tube and communicated with said opening of said vertical main tube, a fan member slidably disposed in said pocket, said fan member having a fan, a fan motor and a housing, and a L-shaped downward tube extended from said pocket, a movable ball valve disposed to move between a first position in said flapper tube adjacent said flapper valve to a second position in the lower portion of said vertical main tube for allowing exhaust gas to flow from the bowl to the non-siphon passage in said first position or flush water to flow from the toilet water holding tank via said flapper tube to the toilet bowl in said second position, and a motion sensor disposed on the front exterior of said toilet water holding tank, said motion sensor being free of interference from the opening and closing of the toilet seat cover due to said sensor aperture of the toilet seat cover, whereby with the toilet seat cover open, while the user sits on the seat ring, the motion sensor actuates for allowing the valve motor to be operated so that the circular plate valve moves upwardly to the bottom of the valve motor through the screwing relationship of the outer-screwing motor shaft and the inner-screwing tubular shaft and simultaneously the fan motor and fan operate for allowing the objectionable odor to be ventilated, and in turn when the user stands up and flushes the toilet assembly, the motion sensor deactivates and simultaneously, the flush water discharges the waste products and associated objectionable odor directly to the sewer discharge line.

2. The non-siphon type ventilating toilet assembly of claim 1, wherein said vertical main tube is provided with a L-shaped upward tube connected to the lower portion thereof, said L-shaped upward tube including a ball seat disposed at the top portion thereof for containing a water overflow controlling movable ball valve so as to discharge overflowing flush water from the toilet water holding tank to the toilet stool.

3. The non-siphon type ventilating toilet assembly of claim 2, wherein said ball seat is provided with a net ball cap supported by said ball seat for allowing movement of said water overflow controlling ball valve between the net ball cap and the ball seat.

4. The non-siphon type ventilating toilet assembly of claim 1, wherein said lower portion of said vertical main tube contains a C-shaped ball guide line for allowing movement of a movable ball valve along the C-shaped ball guide line.

5. The non-siphon type ventilating toilet assembly of claim 4, wherein said movable ball valve can be stopped at a second circumferential raised portion of the vertical main tube.

6. The non-siphon type ventilating toilet assembly of claim 1, wherein said U-shaped multifunctional tube further includes a cover with a rubber gasket for closing the top of the vertical main tube and the pocket.

7. The non-siphon type ventilating toilet assembly of claim 1, wherein said motion sensor is provided with a sensor box, a threaded tubular support, a rubber packing, a glass cover, and a tubular screw having a circumferential extension, whereby the sensor box containing the motion sensor can easily attached to the front exterior of the toilet water holding tank and is connected to the electric source with DC12 volts.

8. The non-siphon type ventilating toilet assembly of claim 7, wherein said motion sensor is inoperative when the user is apart from the predetermined area therefrom.

9. The non-siphon type ventilating toilet assembly of claim 8, wherein the predetermined area is about 1 foot from said motion sensor.

* * * * *